United States Patent [19]

Urbinati et al.

[11] 4,240,384

[45] Dec. 23, 1980

[54] INDUCTION UNITS FOR INTERNAL COMBUSTION ENGINES WITH PETROL INJECTION

[75] Inventors: Mario Urbinati, Turin; Alessandro Nannini, Vinovo, both of Italy

[73] Assignee: Centro Ricerche Fiat S.p.A., Orbassano, Italy

[21] Appl. No.: 39,550

[22] Filed: May 16, 1979

[30] Foreign Application Priority Data

Jun. 26, 1978 [IT] Italy ..... 68493 A/78

[51] Int. Cl.[3] ..... F02B 3/00; F02M 39/00

[52] U.S. Cl. ..... 123/470; 239/533.3

[58] Field of Search ..... 123/139 AW, 32 JV, 32 R, 123/32 AE; 239/533.1-533.15; 403/243, 365, 375; 285/231, 346, DIG. 22

[56] References Cited

U.S. PATENT DOCUMENTS

| | | | |
|---|---|---|---|
| 2,893,365 | 7/1959 | Haefner | 123/139 AW |
| 3,750,960 | 8/1973 | Back et al. | 239/533.3 |
| 3,776,209 | 12/1973 | Wertheimer et al. | 123/32 R |
| 3,799,138 | 3/1974 | Porsche et al. | 123/139 AW |
| 3,857,573 | 12/1974 | Pugh | 123/139 AW |

FOREIGN PATENT DOCUMENTS

| | | | |
|---|---|---|---|
| 973765 | 9/1975 | Canada | 123/32 JV |

*Primary Examiner*—P. S. Lall

*Attorney, Agent, or Firm*—Sughrue, Rothwell, Mion, Zinn & Macpeak

[57] ABSTRACT

An induction unit for a petrol injection engine has an induction manifold formed with seats for respective fuel injectors, the injectors being retained on their seats by a retaining plate which is secured to the induction manifold C-shaped spring clips releasably snap-engaged in recesses in the retaining plate.

3 Claims, 4 Drawing Figures

INDUCTION UNITS FOR INTERNAL COMBUSTION ENGINES WITH PETROL INJECTION

DESCRIPTION

The present invention relates to the induction units for internal combustion engines with petrol injection. More particularly, the invention concerns induction units of the type comprising a plurality of fuel injectors, an induction manifold provided with seats adapted to receive and to support the said injectors, a retaining member for retaining each injector on its respective seat in the induction manifold, and means for securing the retaining member to the induction manifold.

The induction manifold in units of the aforesaid type is provided with a member of tapped holes to allow the fixing of the retaining member by screws. This necessitates drilling and tapping during manufacture, and precise machining of the surface of the induction manifold on which the retaining member bears.

The object of the present invention is to provide an induction unit of the type specified above which is of simpler and more economical construction than previously known units and which makes it possible to fit and remove the fuel injectors both easily and quickly.

With the aforesaid object in view, the present invention provides an induction unit for internal combustion engines with petrol injection comprising a plurality of fuel injectors, an induction manifold adapted to receive said injectors, said manifold having respective seats for supporting said injectors, a retaining member for retaining each injector on its respective seat in the induction manifold, and means for securing the retaining member to the induction manifold, characterised in that the said securing means comprise at least one releasable resilient retaining element connecting said retaining member to the induction manifold.

Use of the induction unit according to the invention makes it possible to avoid the peviously mentioned machining steps during manufacture. Moreover, the use of an elastic element ensures the application of a constant load on the injectors and ensures sealing of the injectors to the retaining member.

In a preferred embodiment of the invention, each resilient retaining element comprises a C-shaped strip spring, the said retaining member comprising a plate, having, for each spring, a seat which is releasably engageable by snapping action by one end of the said spring, the said unit further comprising, in correspondence with each spring, a support member secured to the induction manifold and having a lug for anchoring the other end of the spring.

The invention will be further described, by way of example, with reference to the accompanying drawings, in which.

Figure 1:
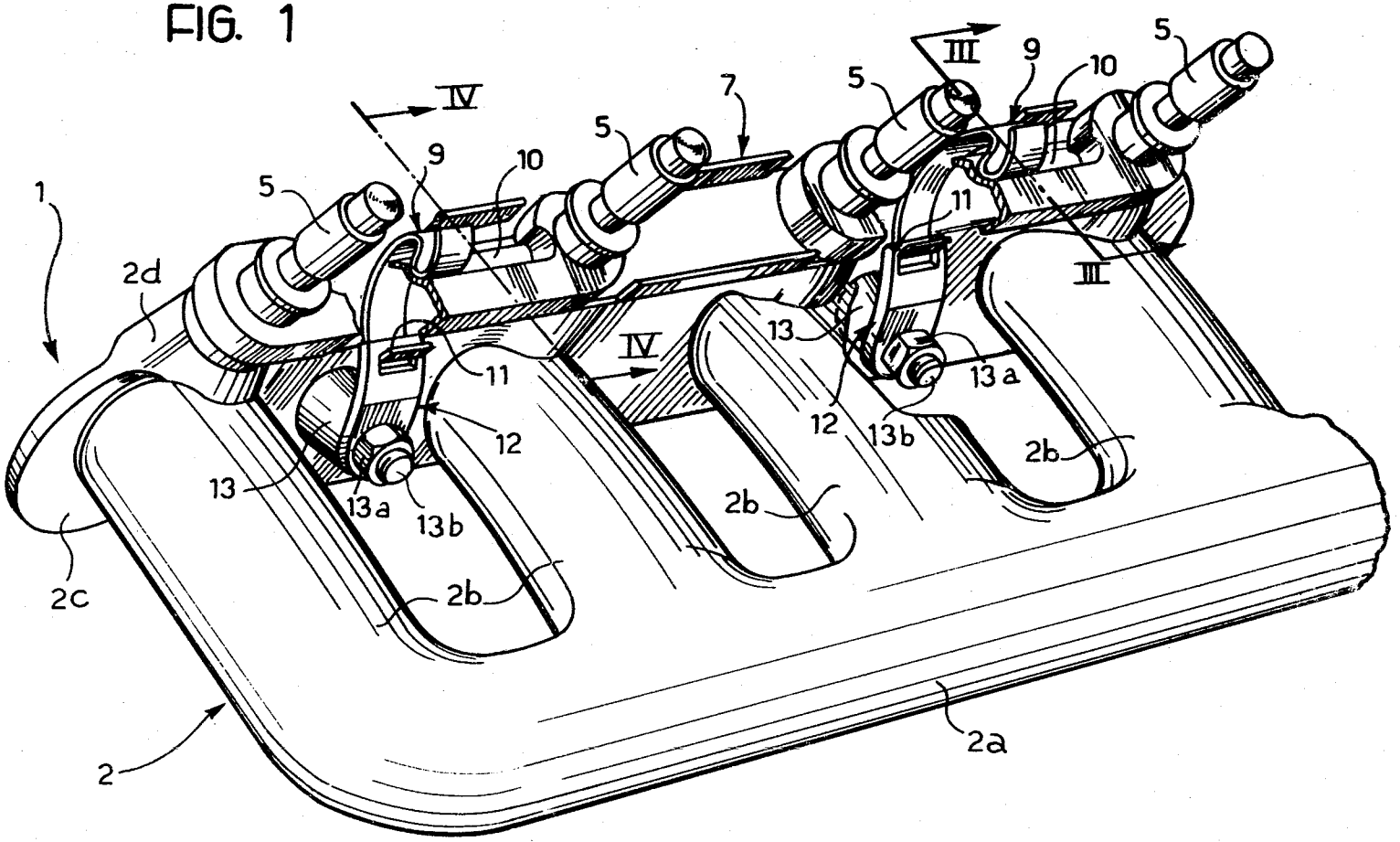
FIG. 1 is a perspective view of an induction unit according to one embodiment of the invention.
Figure 2:
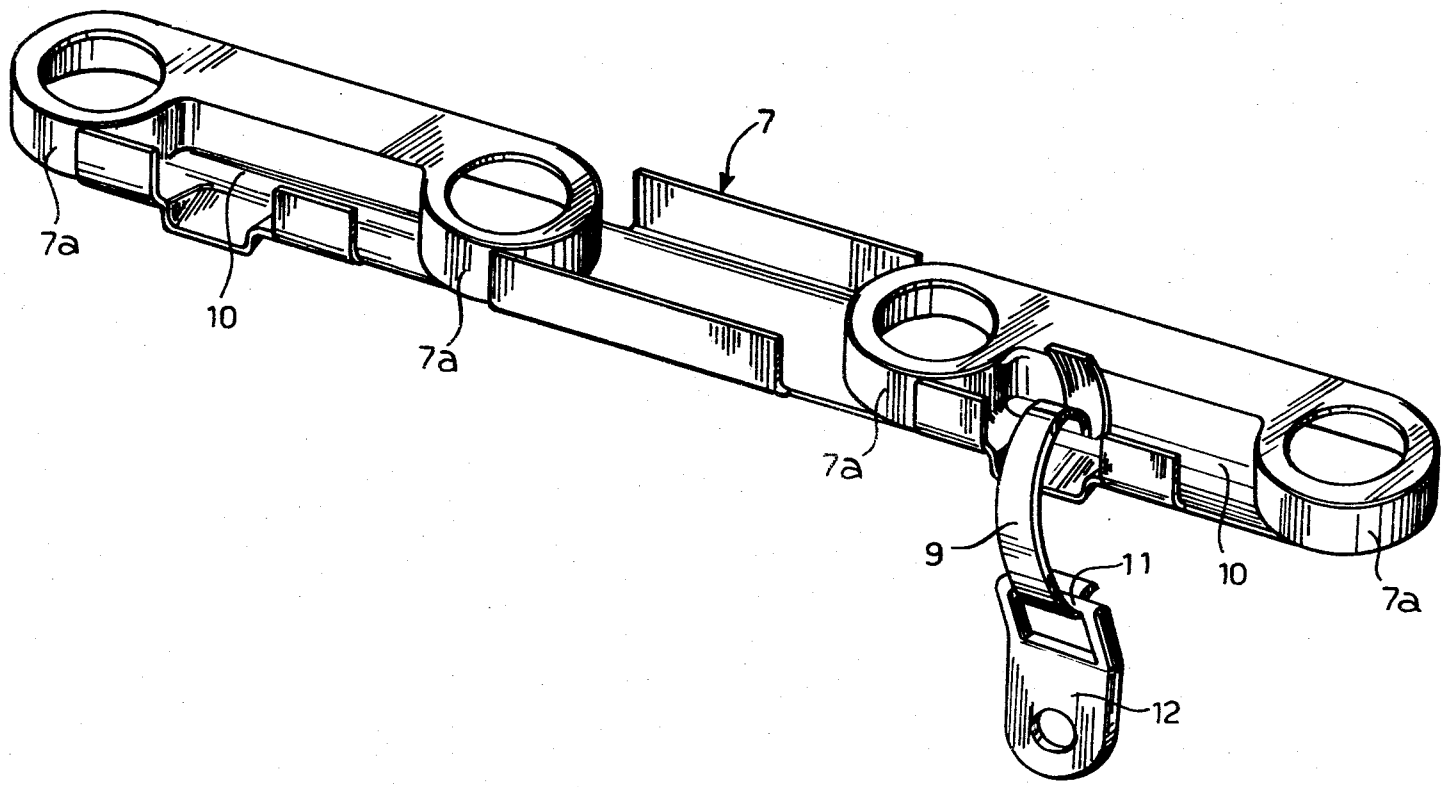
FIG. 2 is a perspective view of the retaining member forming part of the unit shown in FIG. 1.

Referring first to FIG. 1, reference numeral 1 indicates generally an induction unit comprising an induction manifold 2 including a supply duct 2*a* and four branch ducts 2*b* for the supply of air to the cylinders of an internal combustion engine (not shown) with petrol injection. The free ends of the ducts 2*b* are provided with flanges 2*c* by which the manifold 2 is fixed to the engine block.

The induction manifold 2 is also formed, adjacent the free end of each duct 2*b*, with an integral boss 2*d*, (see FIG. 3) having a cylindrical through bore 2 communicating with the respective duct 2*b*. The wall of the bore 3 receives a respective fuel injector 5 which bears against an internal annular seat 4 in the bore 3 through the interposition of elastic seals 6.

Figure 3:
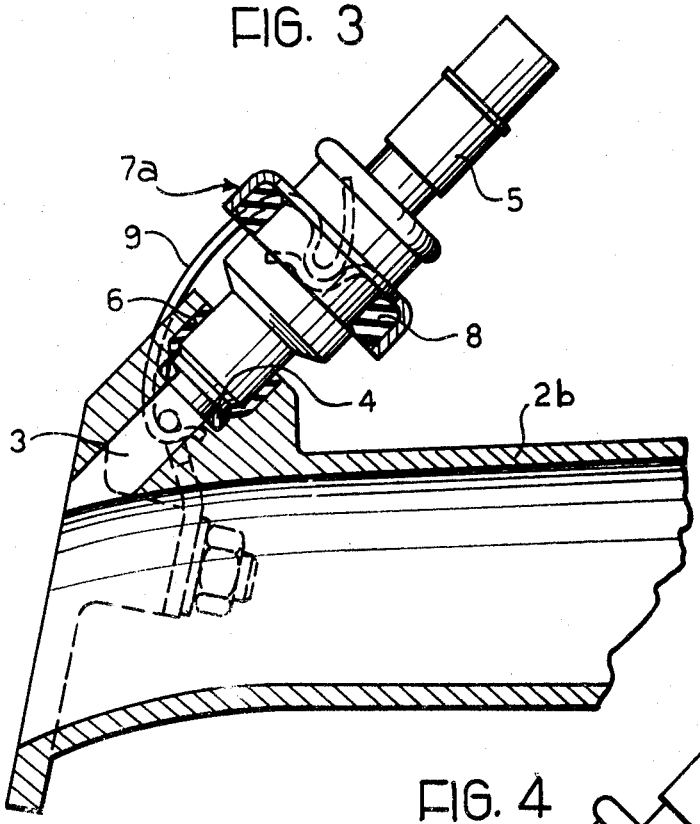
FIG. 3 is a cross section taken along the line III—III of FIG. 1.

An injector retaining plate 7 is formed with four seats 7*a*, each shaped like a hollow cap, for retaining a respective elastic packing ring 8 which surrounds the respective injector 5 (FIG. 3).

Figure 4:
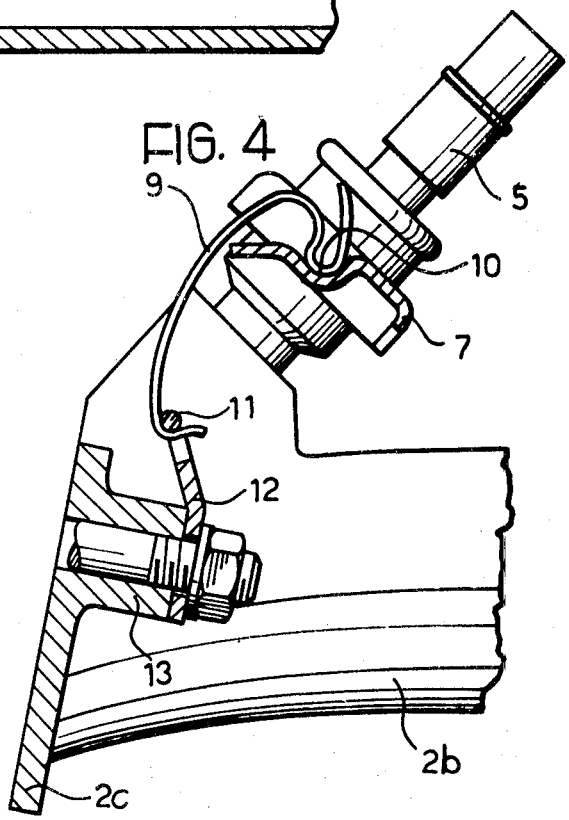
FIG. 4 is a cross section taken along the line IV—IV of FIG. 1.

The retaining plate 7 is connected to the induction manifold 2 by means of two C-shaped retaining springs 9 of resilient metal strip. The plate 7 is formed in correspondence with each spring 9, with a recess 10 into which a suitably shaped free end of the spring 9 snaps (FIG. 4). The opposite end of the spring 9 is hooked over a connecting lug 11 attached to a respective support member 12 which is secured to a respective boss 13 formed on the induction manifold 2 by a nut 13*a* threaded on a stud 13*b* which passes through a hole in the boss 13. The nuts 13*a* also serve to secure the induction manifold 2 to the engine block. The support member 12 may alternatively be formed by casting in a single piece with the induction manifold 2.

When removing the fuel injectors 5 for replacement or inspection it is simply necessary to release the retaining plate 7 from the induction manifold 2 by unclipping the springs 9 from the respective recesses 10 in the said plate element. This unclipping can be effected manually without the aid of tools.

As may be seen in FIG. 4, the free ends of the retaining springs 9 lie in the plane containing the axes of the injectors 5 in such a way as to ensure the application of a constant retaining force to the injectors 5 in the direction of their axes, automatically taking up and play which may exist between each injector 5 and the respective seat 4 against which it bears.

We claim:

1. An induction unit for an internal combustion engine with fuel injection, comprising:

a plurality of fuel injectors having parallel axes, an induction manifold adapted to receive said injectors, said manifold having respective seats for supporting said injectors, a retaining member for retaining each of said injectors on its respective seat in said induction manifold, and means for securing said retaining member to said induction manifold, wherein said securing means comprises at least one C-shaped strip spring, support means pivotably connecting one end of said strip spring to said manifold, wherein said retaining member comprises a plate having, in correspondence with each said spring, a seat in which the other end of each said spring is releasably engageable by a snap action, and wherein the ends of said C-shaped strip spring are disposed in a plane containing the axes of said injectors on a line parallel to said axes to provide a constant retaining force to said injectors in the direction of their axes.

2. An induction unit as set forth in claim 1, wherein said induction manifold has, in correspondence with each said spring, a boss provided with a hole for passage of screw-threaded means for securing said support means to said induction manifold and for securing said induction manifold to the engine.

3. An induction unit as set forth in claim 1, wherein said support means are of integral one piece construction with said induction manifold.

* * * * *